US007882782B2

(12) United States Patent
Korthäuer

(10) Patent No.: US 7,882,782 B2
(45) Date of Patent: Feb. 8, 2011

(54) PRINTING DEVICE HAVING PRINT HEAD AND COUNTERPRESSURE SURFACE IN FIXED RELATIONSHIP

(75) Inventor: Manfred Korthäuer, Mulheim (DE)

(73) Assignee: Espera-Werke GmbH, Duisburg (DE)

( * ) Notice: Subject to any disclaimer, the term of this patent is extended or adjusted under 35 U.S.C. 154(b) by 839 days.

(21) Appl. No.: 10/561,584

(22) PCT Filed: Jun. 16, 2004

(86) PCT No.: PCT/EP2004/006453

§ 371 (c)(1),
(2), (4) Date: Dec. 19, 2005

(87) PCT Pub. No.: WO2004/110903

PCT Pub. Date: Dec. 23, 2004

(65) Prior Publication Data

US 2007/0095230 A1 May 3, 2007

(30) Foreign Application Priority Data

Jun. 18, 2003 (DE) ..... 103 27 742

(51) Int. Cl.
*B41J 11/06* (2006.01)
*B41J 2/32* (2006.01)

(52) U.S. Cl. ..... 101/288; 400/120.01; 400/656

(58) Field of Classification Search ..... 400/656, 400/23, 24, 120.01, 120.16, 120.17; 101/288; 347/197, 198, 220
See application file for complete search history.

(56) References Cited

U.S. PATENT DOCUMENTS 5,967,040 A 10/1999 Korthauer et al. ..... 101/288

FOREIGN PATENT DOCUMENTS

EP 0900735 3/1999
WO WO 01/85548 11/2001

*Primary Examiner*—Leslie J Evanisko
(74) *Attorney, Agent, or Firm*—Alfred A. Fressola; Ware, Fressola, Van Der Sluys & Adolphson LLP

(57) ABSTRACT

A printing device for printing sheet elements (2) that are serially fed to the printing device, in particular product labels made of temperature-sensitive paper or paper substitute materials, comprises at least two separate feed devices (3*a*, . . . , 3*f*) for each liner strip (1) comprising the sheet elements (2), wherein each feed device (3*a*, . . . , 3*f*) comprises a peeling-off device (4*a*, . . . , 4*f*) for peeling the sheet elements (2) from the liner strip (1), and wherein the feed devices (3*a*, . . . , 3*f*) are associated with a print head (5*a*, . . . , 5*f*) with a thermal slat (6*a*, . . . , 6*f*) for printing a sheet element supported by a counterpressure surface (7*a*, . . . , 7*f*), and comprising an application device (8) for removing the printed sheet element from the print head (5*a*, . . . , 5*f*) and for applying the printed sheet element to a product.

13 Claims, 2 Drawing Sheets

PRINTING DEVICE HAVING PRINT HEAD AND COUNTERPRESSURE SURFACE IN FIXED RELATIONSHIP

CROSS REFERENCE TO RELATED APPLICATIONS

This application is for entry into the U.S. national phase under §371 for International Application No. PCT/EP2004/006453 having an international filing date of Jun. 16, 2004, and from which priority is claimed under all applicable sections of Title 35 of the United States Code including, but not limited to, Sections 120, 363 and 365(c) and which in turn claims priority under 35 U.S.C. §119 to German Patent Application DE10327742.0 filed on Jun. 18, 2003.

TECHNICAL FIELD

The invention relates to a printing device for printing sheet elements that are serially fed to the printing device, in particular product labels made of temperature-sensitive paper or paper substitute materials, comprising at least two separate feed devices for each liner strip comprising the sheet elements, wherein each feed device comprises a peeling-off device for peeling the sheet elements from the liner strip, and wherein the feed devices are associated with a print head with a thermal slat for printing a sheet element supported by a counterpressure surface, and comprising an application device for removing the printed sheet element from the print head and for applying said printed sheet element to a product.

BACKGROUND OF THE INVENTION

A device of this type is known from EP 0 900 735 B1. The device is a label printer for printing self-adhesive labels attached to a liner strip.

In this known device each of the separate feed devices, of which there are at least two, comprises a counterpressure surface on which the label that is about to be printed rests. Each of the feed devices operates with liner strips to which labels of different geometries are affixed so that the desired labels can be sequentially applied to products of different types and sizes. In this arrangement, the feed devices share a print head which comprises a thermal slat by means of which the temperature-sensitive label is printed. The printing process takes place in that the counterpressure surfaces of the label feed devices move in relation to the print head and in that the printing process takes place at that point in time at which the desired counterpressure surface is in the printing position.

Practical application has shown that the known device is of a comparatively complex mechanical design and that due to the relative movements between the print head and the respective counterpressure surface the association between the counterpressure surfaces and the thermal slat becomes inaccurate so that the print quality is compromised.

SUMMARY OF THE INVENTION

It is thus the object of the invention to further develop a device of the type mentioned in the introduction such that the mechanical design is simplified, the variability of the design is enhanced and the print quality is improved.

According to the invention this object is met in that the counterpressure surface forms part of the print head.

Because in this design the counterpressure surface now forms part of the print head, there is no longer a relative movement, as known from the state of the art, between the counterpressure surface and the thermal slat of the print head. Instead, as a result of the rigid association between the counterpressure surface and the thermal slat of the printer the label is stabilised at the print-active surface of the thermal slat. This results in a significantly simplified design because it is now possible to do away with the components that allow relative movement.

A first preferred variant of the invention provides for each feed device to be associated with a print head. This results in a particularly sturdy and simple design of the arrangement. In this arrangement, positioning of the feed devices, of which there are several, can take place along a longitudinal path or along a path in the shape of a graduated circle so that corresponding variability of design is provided.

It is a common feature of this variant that at the desired points in time printing of the label takes place in the respectively formed units comprising the feed device, the print head and the counterpressure surface, and that removal of the printed label from the respective print head and application to a product can be achieved by correspondingly timed control of the application device. This variant is associated with a further advantage in that if repairs become necessary one unit comprising a feed device and print head can be shut down and exchanged or repaired without there being a need to shut down the remaining printing device.

In a second preferred variant of the invention, the feed devices are arranged vertically, one on top of the other, wherein preferably the application device is a stamp that can be moved in vertical or perpendicular direction thereto, and the association of the respectively active print head with the desired feed device is established via an additional adjustment device which is coupled to the application device. This also results in a printing device of a compact design and of enhanced functionality. In an embodiment of this variant a shared print head is associated with the individual feed devices, wherein said shared print head incorporates the counterpressure surface—an arrangement that differs from that in the state of the art. By means of the adjustment device the print head is adjusted in such a way in relation to the selected feed device that the selected liner strip is supplied to the printing position and subsequently the printing process is initiated. After completion of the printing process the application device coupled to the adjustment device removes the printed label and places it onto the product.

The solution according to the invention can preferably be applied to sheet elements in the form of product labels. Such product labels can either be removably affixed to a liner strip, being removable from the liner by means of a so-called peeling-off device, or they can be linerless labels or continuous material. Furthermore, it is possible to use thermotransfer print labels in which the print image is transferred from an intermediate medium to the label by heating the thermal slat.

BRIEF DESCRIPTION OF THE DRAWINGS

Below, the invention is explained in more detail with reference to drawings, each showing sectional views of embodiments, as follows:

FIG. 1 shows a sectional view of a printing device known from the state of the art. In this known device several feed units 3 are provided, of which, for the sake of clarity, only one is shown. Such a label feed unit 3 comprises a take-up reel, a take-off reel, between which reels a liner strip 1 extends with labels 2 that have been removably affixed to it. The liner strip 1 is guided over a peeling-off device 4, which is arranged underneath a thermal slat 6 of a print head 5 in the position shown in FIG. 1. The top of the peeling-off device 4 forms a counterpressure surface 7 which at the time the printing process takes place interacts with the thermal slat 6. As a result of the deflection of the liner strip 1 on the edge of the peeling-off device 4, which edge is at the delivery end, the printed label 2 is peeled off the liner strip 1 and by means of an application device 8 that is arranged downstream is moved away from the print head and is affixed to a product (not shown). If a label of a different type, which is located on a different liner strip in one of the other feed units (not shown), is to be applied, the peeling-off device of this device is placed into the position of the peeling-off device 4 of FIG. 1. This can take place either by moving the print head 5 or by corresponding feed movement of the selected feed device. In this way labels of different types can be printed and sequentially applied to the associated products.

Figure 1:
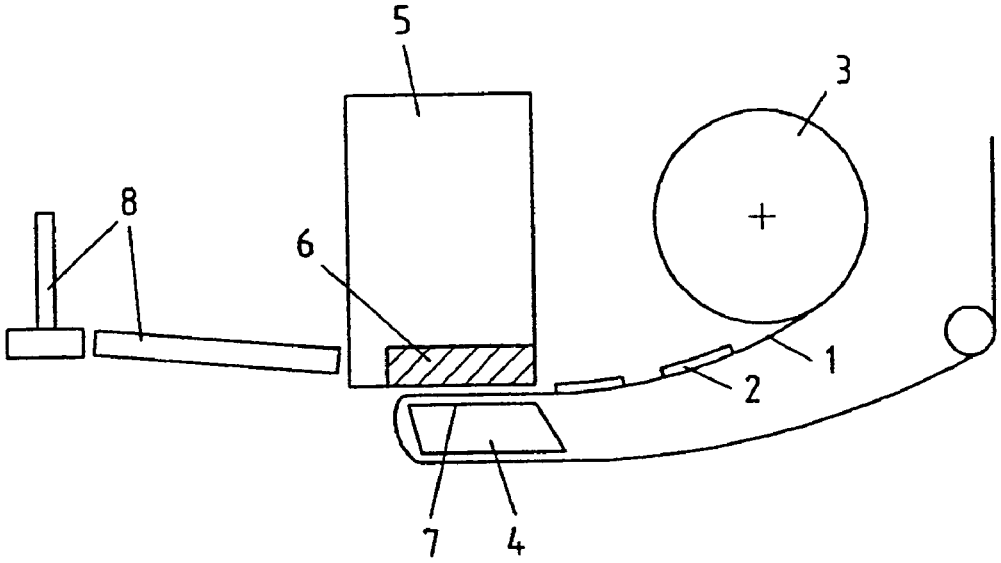
Fig.1 PRIOR ART
FIG. 1 a printing device known from the state of the art.
Figure 2:
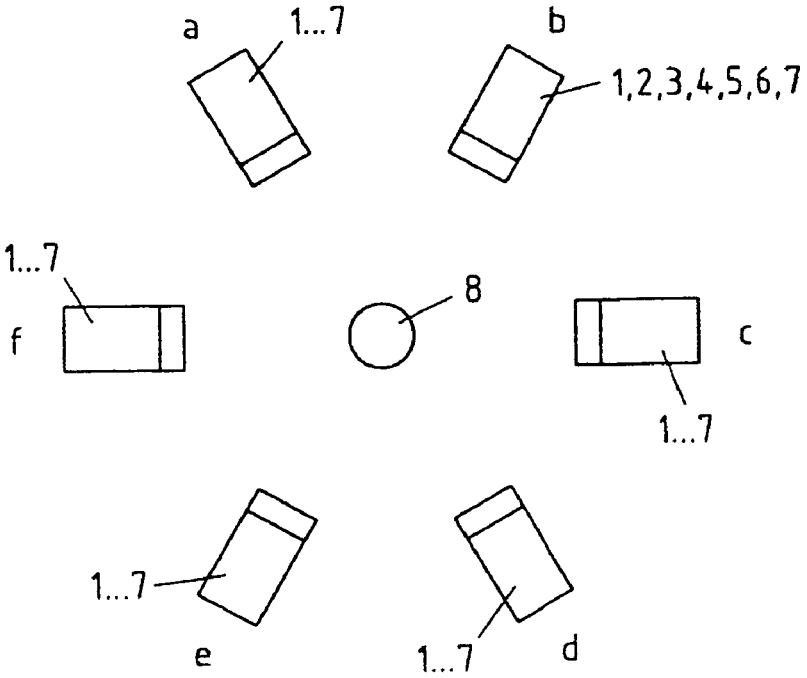
FIG. 2 a first embodiment of a first variant of the invention.

The first embodiment, shown in FIG. 2, of the first variant of the invention shows six units for printing labels, which units are positioned on a circular path around an application device 8 arranged in the center. Each of these printing devices comprises a print head 5*a*-5*f* with thermal slats 6*a*-6*f*. Each of the label feed units comprises a take-off reel and a take-up reel and a peeling-off device 4*a*-4*f*. Each take-off reel accommodates a roll of labels, wherein each roll of labels comprises a liner strip and labels affixed thereon. In each case the liner strip is deflected by way of the peeling-off device 4*a*-4*f* of the label feed unit. To print the label it is conveyed on the liner strip 1 to the appropriate position of the counterpressure surface that is opposite the thermal slat of the print head and that forms part of the print head.

In all the units a-f the described printing process takes place separately from the other units. The application device 8 removes the printed label from the respective unit a-f and conveys and applies said label to the product (not shown).

Figure 3:
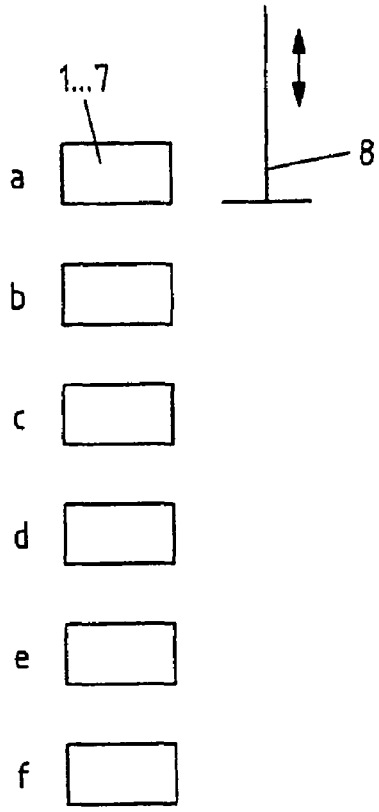
FIG. 3 a second embodiment of the first variant of the invention.

The second embodiment, shown in FIG. 3, of the first variant of the invention differs from the embodiment shown in FIG. 2 only in that the individual units a-f are not arranged on a circular path in relation to the applicator unit 8, but instead are arranged along a linear path.

The function is analogous.

Figure 4:
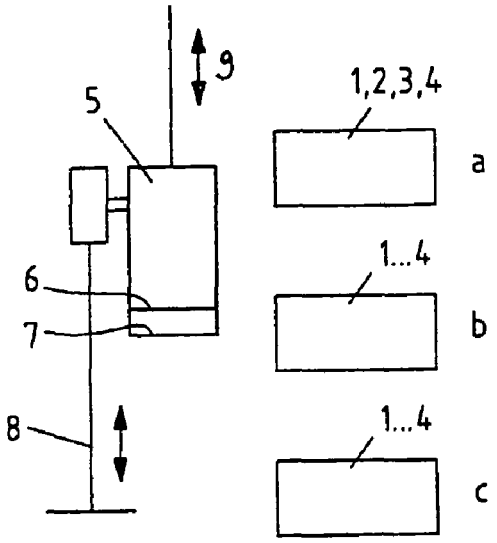
FIG. 4 a first embodiment of the second variant of the invention.

The first embodiment, shown in FIG. 4, of the second variant of the invention shows several feed units 3*a*, 3*b*, 3*c*, arranged vertically one on top of the other, for liner strips with labels which can be of the same principal design but can for example be suitable for liner strips with labels of different widths.

The feed units 3*a*-3*c* share a print head 5 and a thermal slat 6, associated with said print head 5 which can be vertically moved by way of an adjustment device 9. An application device 8, which can also be moved in vertical direction, is coupled to said adjustment device 9. The stamp of the application device 8 can be positioned in length such that the underside of the stamp can be brought into contact with the product.

The described device functions as follows:

First the feed unit 3*a*-3*c* from which the next label is to be printed is selected. Then, by means of the adjustment device 9, the print head 5 with the thermal slat 6 is moved in a vertical position such that the feed region underneath the thermal slat 6 of the print head 5 is flush with the delivery region of the selected feed device 3*a*, 3*b*, 3*c*. Then the label that has been peeled off the liner strip and that is to be printed is conveyed to the counterpressure surface underneath the thermal slat of the printer, and the printing process is carried out. Quasi simultaneously the printed label is taken over by the application device 8 and is affixed to the product. In the subsequent process step the next label is printed in that again the desired feed device 3*a*-3*c* is selected, the print head is moved to the respective vertical position by means of the additional adjustment device, and the selected label is fed in, printed and applied as described above.

The invention claimed is:

1. A printing device for printing sheet elements (2) that are serially fed to the printing device comprising:

at least two separate feed devices (3*a*, . . . , 3*f*) for at least one liner strip (1) having the sheet elements (2) removably affixed thereto, wherein each feed device (3*a*, . . . , 3*f*) comprises a separate peeling-off device (4*a*, . . . , 4*f*) for peeling the sheet elements (2) from each of the at least one liner strip (1), and wherein each feed device (3*a*, . . . , 3*f*) is associated with a print head (5*a*, . . . , 5*f*) with a thermal slat (6*a*, . . . , 6*f*) for printing each sheet element supported by a counterpressure surface (7*a*, . . . , 7*f*); and an application device (8) for removing each printed sheet element from the print head (5*a*, . . . , 5*f*) and for applying each printed sheet element to a product, characterised in that the counterpressure surface (7*a*, . . . , 7*f*) forms part of the print head (5*a*, . . . , 5*f*) so as to maintain a fixed relationship to said print head so that no relative movement between the counterpressure surface and the print head can occur and wherein the counterpressure surface and the thermal slat are configured to have a rigid association therebetween so as to stabilize the sheet element at a print-active surface of the thermal slat.

2. The printing device according to claim 1, characterised in that the feed devices (3*a*, . . . , 3*f*) are arranged along a longitudinal path.

3. The printing device according to claim 2, characterised in that the application device (8) is a stamp that can be moved in a direction that is perpendicular to the longitudinal path.

4. The printing device according to claim 1, characterised in that the feed devices (3*a*, . . . , 3*f*) are arranged along a path in the shape of a graduated circle.

5. The printing device according to claim 4, characterised in that the application device (8) is arranged so as to be centered within the path in the shape of the graduated circle.

6. The printing device according to claim 1, characterised in that a single print head (5) is associated with the feed devices (3*a*, . . . , 3*c*), of which there are several, and in that association of the print head with the respective feed device (3*a*, . . . , 3*f*) takes place via an adjustment device (9).

7. The printing device according to claim 6, characterised in that the feed devices (3*a*, . . . , 3*c*) are arranged vertically, one on top of the other.

8. The printing device according to claim 7, characterised in that the application device (8) is embodied as a stamp that can be moved in a vertical direction.

9. The printing device according to claim 6, characterised in that the application device (8) is coupled to the adjustment device (9).

10. The printing device according to claim 6, characterised in that the application device (8) and the adjustment device (9) can each be moved independently from each other along a single axis.

11. The printing device according to claim 6, characterised in that an additional application device removes the labels from the feed devices (3*a*, . . . , 3*f*) and feeds them to the print head (5).

12. The printing device according to claim 1, characterised in that the application device is operated pneumatically, hydraulically or electrically.

13. The printing device according to claim 1, characterised in that the application device can be moved along multiple axes or in a rotary manner.

* * * * *